US010003883B2

(12) United States Patent
Moro

(10) Patent No.: US 10,003,883 B2
(45) **Date of Patent: *Jun. 19, 2018**

(54) SEALED SPEAKER SYSTEM HAVING A PRESSURE VENT

(71) Applicant: Harman International Industries, Inc., Stamford, CT (US)

(72) Inventor: Jerry Moro, Moorpark, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 76 days.

This patent is subject to a terminal disclaimer.

(21) Appl. No.: 15/049,791

(22) Filed: Feb. 22, 2016

(65) Prior Publication Data

US 2016/0173972 A1 Jun. 16, 2016

Related U.S. Application Data

(63) Continuation of application No. 14/267,318, filed on May 1, 2014, now Pat. No. 9,301,043.

(60) Provisional application No. 61/818,094, filed on May 1, 2013.

(51) Int. Cl.

| | |
|---|---|
| ***H04R 1/28*** | (2006.01) |
| ***H04R 1/02*** | (2006.01) |
| ***H04R 1/26*** | (2006.01) |
| *H04R 1/08* | (2006.01) |

(52) U.S. Cl.

CPC ..... *H04R 1/2803* (2013.01); *H04R 1/021* (2013.01); *H04R 1/26* (2013.01); *H04R 1/28* (2013.01); *H04R 1/288* (2013.01); *H04R 1/2811* (2013.01); *H04R 1/2849* (2013.01); *H04R 1/2888* (2013.01); *H04R 1/086* (2013.01); *H04R 2201/029* (2013.01)

(58) Field of Classification Search

CPC ..... H04R 1/02; H04R 1/021; H04R 1/026; H04R 1/086; H04R 1/28; H04R 1/2803–1/2896; H04R 2201/02; H04R 2201/029; H04R 2460/11

See application file for complete search history.

(56) References Cited

U.S. PATENT DOCUMENTS

| | | | | |
|---|---|---|---|---|
| 2,129,184 A * | 9/1938 | Roy | ..... | H04R 1/2819 181/148 |
| 2,429,470 A * | 10/1947 | Knowles | ..... | H04R 1/2873 381/348 |
| 2,834,423 A | 5/1958 | Bradford | | |
| 2,846,520 A | 8/1958 | Brownscombe | | |
| 3,164,221 A | 1/1965 | Rich | | |
| 3,365,021 A | 1/1968 | Transue | | |

(Continued)

*Primary Examiner* — Joshua Kaufman

(74) *Attorney, Agent, or Firm* — Brooks Kushman P.C.

(57) ABSTRACT

A sealed speaker system includes an enclosure and a transducer diaphragm mounted within the enclosure, where an increase in air pressure within the enclosure results in an outward movement of the diaphragm toward an exterior of the enclosure, and a decrease in air pressure within the enclosure results in an inward movement of the diaphragm toward an interior of the enclosure. A pressure vent is provided in the enclosure and allows a gradual transfer of air between the enclosure interior and the enclosure exterior to substantially maintain a pressure equilibrium between the enclosure interior and the enclosure exterior.

12 Claims, 7 Drawing Sheets

(56) References Cited

U.S. PATENT DOCUMENTS 3,371,742 A * 3/1968 Norton ..... H04R 1/345 181/153
3,547,221 A 12/1970 Hedberg
3,580,988 A 5/1971 Orlowski et al.
3,586,794 A * 6/1971 Michaelis ..... H04R 9/10 181/129
3,667,568 A 6/1972 Liebscher
3,930,560 A 1/1976 Carlson et al.
3,944,756 A 3/1976 Lininger
4,450,930 A 5/1984 Killion
4,618,025 A * 10/1986 Sherman ..... H04R 1/22 181/148
4,657,108 A 4/1987 Ward
4,805,728 A 2/1989 Carter et al.
4,889,208 A * 12/1989 Sugihara ..... H04R 1/288 181/141
5,073,937 A * 12/1991 Almasy ..... H04R 1/2819 181/148
5,146,435 A * 9/1992 Bernstein ..... G01H 11/06 29/25.42
5,689,573 A 11/1997 Jones
5,721,786 A 2/1998 Carrington
5,748,759 A 5/1998 Croft et al.
5,802,198 A 9/1998 Beavers et al.
7,068,806 B2 6/2006 Walsh
7,181,039 B2 2/2007 Stiles et al.
7,201,252 B2 * 4/2007 Nevill ..... H04R 1/345 181/151
7,325,649 B1 2/2008 Budge
8,055,003 B2 * 11/2011 Mittleman ..... H04M 1/035 381/345
8,107,662 B2 1/2012 Parker
8,139,805 B2 3/2012 Tsai
8,184,826 B2 5/2012 Matsumura et al.
9,288,561 B1 * 3/2016 Chu ..... H04R 1/2834
2002/0012439 A1 * 1/2002 Schafer ..... H04R 1/2819 381/349
2004/0008863 A1 1/2004 Hutt et al.
2004/0136560 A1 * 7/2004 Walsh ..... H04R 9/06 381/401
2004/0173402 A1 9/2004 Morkerken
2004/0251079 A1 12/2004 Plummer
2005/0094837 A1 5/2005 Parker et al.
2006/0018488 A1 * 1/2006 Viala ..... H04R 1/1091 381/74
2006/0219474 A1 10/2006 Goh et al.
2007/0127760 A1 * 6/2007 Saiki ..... H04R 1/2803 381/351
2007/0147645 A1 6/2007 Kuze et al.
2007/0217760 A1 6/2007 Saiki et al.
2008/0240483 A1 10/2008 Godiska et al.
2009/0028370 A1 1/2009 Matsumura et al.
2009/0245565 A1 10/2009 Mittleman et al.
2010/0080400 A1 * 4/2010 Sibbald ..... H04R 3/002 381/71.6
2011/0051983 A1 * 3/2011 Jorgensen ..... A61L 9/122 381/386
2011/0069852 A1 * 3/2011 Arndt ..... H04R 25/48 381/317
2012/0128190 A1 * 5/2012 Tam ..... H04R 1/42 381/346
2012/0328141 A1 12/2012 Parker et al.
2013/0129119 A1 5/2013 Miyatake et al.
2013/0271902 A1 10/2013 Lai et al.
2013/0308809 A1 * 11/2013 Thompson ..... H04R 1/2834 381/332
2014/0029782 A1 1/2014 Rayner
2014/0093113 A1 4/2014 Dix et al.
2014/0161290 A1 6/2014 Jenkins et al.
2015/0016652 A1 1/2015 Moro
2015/0036831 A1 2/2015 Klippel
2015/0078603 A1 3/2015 van Halteren et al.
2015/0163572 A1 * 6/2015 Weiss ..... H04R 1/02 381/337
2016/0044397 A1 * 2/2016 Ozcan ..... H04R 1/028 381/394
2016/0165335 A1 * 6/2016 Goossens ..... H04R 31/00 381/351
2016/0219362 A1 * 7/2016 Litovsky ..... H04R 1/2834
2016/0353186 A1 * 12/2016 Rothkopf ..... H04R 1/028
2016/0366499 A1 * 12/2016 McGarry ..... H04R 1/023
2017/0048624 A1 * 2/2017 Clerici ..... H04R 19/02
2017/0070812 A1 * 3/2017 Paris ..... H04R 1/2888
2017/0078777 A1 * 3/2017 Mittleman ..... H04R 1/025

* cited by examiner

SEALED SPEAKER SYSTEM HAVING A PRESSURE VENT

CROSS-REFERENCE TO RELATED APPLICATIONS

This application is a continuation of U.S. application Ser. No. 14/267,318, filed May 1, 2014, which claims the benefit of U.S. provisional application Ser. No. 61/818,094 filed May 1, 2013, the disclosures of which are hereby incorporated in their entirety by reference herein.

TECHNICAL FIELD

Embodiments disclosed herein relate to a sealed speaker system having a pressure vent, such as a sealed woofer system.

BACKGROUND

Woofer is the term used for an active loudspeaker driver or transducer designed to produce low frequency "bass" sounds, typically for frequencies between approximately 20 Hz and 250 Hz. Within the lower part of this range, a type of woofer termed a subwoofer is designed to handle the lowest two or three octaves (e.g., between about 20 Hz-120 Hz). It is not unusual for some subwoofer systems to extend to frequencies an octave or more below 20 Hz.

The woofer transducer includes a diaphragm or cone with a flexible surround or suspension driven by a voice coil attached thereto, where the voice coil is surrounded by a motor assembly which generates a magnetic field. When current flows through the voice coil, the coil moves and causes motion of the diaphragm, creating sound waves as the diaphragm moves inward and outward. In order to have reliable sound production, the motion of the diaphragm must be controlled so that the electrical signal to the woofer's voice coil is accurately reproduced by the sound waves produced by the diaphragm's motion.

The transducer is typically mounted within an enclosure or box which couples the diaphragm motion to the air inside the enclosure. In a sealed enclosure, the transducer interacts with a trapped volume of air in the enclosure, such that as the woofer diaphragm moves outward it decreases the air pressure inside the enclosure, and as the woofer diaphragm moves inward it increases the air pressure inside the enclosure. In ideal conditions, this air pressure acting on the woofer's diaphragm from inside the enclosure will be the same as the air pressure acting on the woofer's diaphragm from outside the enclosure, such that both inward and outward diaphragm motion has a symmetrical characteristic. Maintaining a stable, symmetrical and linear pressure within the enclosure is important in order to reliably reproduce sounds with low distortion.

SUMMARY

In one embodiment, a sealed speaker system is provided including an enclosure and a transducer diaphragm mounted within the enclosure, where an increase in air pressure within the enclosure results in an outward movement of the diaphragm toward an exterior of the enclosure, and a decrease in air pressure within the enclosure results in an inward movement of the diaphragm toward an interior of the enclosure. A pressure vent is provided in the enclosure and allows a gradual transfer of air between the enclosure interior and the enclosure exterior to substantially maintain a pressure equilibrium between the enclosure interior and the enclosure exterior.

In another embodiment, a sealed woofer system is provided including an enclosure and a transducer diaphragm mounted within the enclosure by a flexible suspension and having a rest position. An increase in air pressure within the enclosure results in an outward movement of the diaphragm from the rest position toward an exterior of the enclosure, and a decrease in air pressure within the enclosure results in an inward movement of the diaphragm from the rest position toward an interior of the enclosure. A voice coil is attached to the diaphragm for driving motion of the diaphragm in response to an electrical signal. A pressure vent is provided in an opening in the enclosure, the pressure vent including a damping material. The pressure vent allows a gradual transfer of air between the enclosure interior and the enclosure exterior to substantially maintain a pressure equilibrium between the enclosure interior and the enclosure exterior and to substantially return the diaphragm to the rest position in the absence of an electrical signal to the voice coil.

In another embodiment, a sealed speaker system is provided including an enclosure and a transducer diaphragm mounted within the enclosure by a flexible suspension. An increase in air pressure within the enclosure results in an outward movement of the diaphragm toward an exterior of the enclosure, and a decrease in air pressure within the enclosure results in an inward movement of the diaphragm toward an interior of the enclosure. At least one of the suspension and the diaphragm is constructed from a damping material which allows a gradual transfer of air between the enclosure interior and the enclosure exterior to substantially maintain a pressure equilibrium between the enclosure interior and the enclosure exterior.

DETAILED DESCRIPTION

Figure 1:
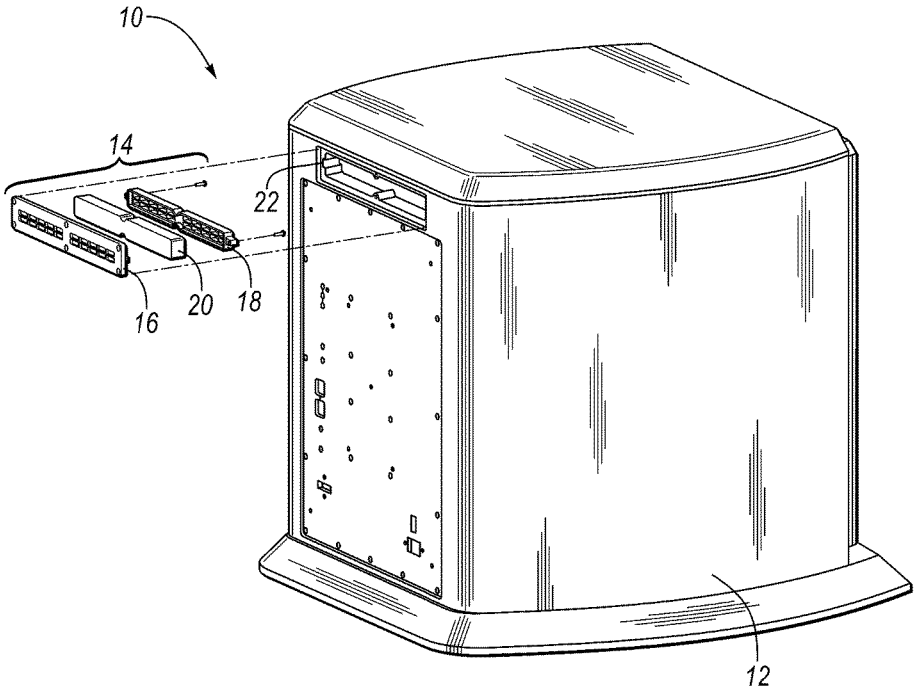
FIG. 1 is an exploded perspective view of a pressure vent for a sealed speaker system according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Typically, a transducer design is balanced and optimized for symmetrical displacement of the moving diaphragm, voice coil and flexible suspension assembly about a rest position with no DC offset (also known as DC bias or rectification). But once mounted into a sealed enclosure, any increase in internal box temperature will generate an increase in air pressure against the transducer diaphragm. The change in pressure or volume due to temperature can be verified by using the Ideal Gas Law, PV=nRT. Since the transducer diaphragm is secured by a flexible suspension (see FIG. 9), this increase in pressure stabilizes by creating an outward displacement or DC offset of the diaphragm, voice coil and suspension. In other words, the increase in pressure results in an increase in volume by way of forward diaphragm displacement toward an exterior of the enclosure.

In the absence of signal level, the diaphragm, voice coil and suspension should be at a correct and optimum zero crossing, or rest position. Upon application of moderate to high level signal in a sealed woofer system, the transducer starts to raise the internal enclosure temperature above ambient or its initial starting temperature, such as due to voice coil heating. This change in temperature creates an increase in internal box pressure which causes an outward displacement of the transducer diaphragm so that a new, incorrect "rest" position is created, analogous to a DC offset. Not only does the diaphragm "rest" position change, but by virtue of their attachment to the diaphragm, the voice coil and suspension also can no longer return to their optimum rest position unless internal box temperature returns to normal ambient condition. Changes of only a few degrees can increase pressure enough to substantially change the motion of the transducer from symmetrical to asymmetrical. This DC offset generates distortion due to various non-linear transducer behaviors, as well as poor power handling due to improper voice coil position within the motor assembly.

A pressure vent or port is described herein which alleviates the internal pressure increase in order to maintain a stable internal enclosure pressure and eliminate DC offset, regardless of any internal temperature increase. The pressure vent slowly leaks air from inside to outside the enclosure, and vice versa, thus offering stable diaphragm motion which reacts to stimulus only, while still allowing the enclosure to remain a sealed box, and thus true to performance as a sealed system. The pressure vent may be externally mounted, such as to create a visible marketing feature, or alternatively may be internally mounted and integrated into the milling of internal enclosure walls/baffles, or through associated speaker components or hardware. In some embodiments, the pressure vent includes or is filled with a damping material to allow an optimized, gradual transfer of air between the inside of the enclosure and the outside of the enclosure, thus maintaining pressure equilibrium on both sides of the transducer diaphragm. Excess pressure build-up within the enclosure can be released through the pressure vent to the outside of the enclosure. As the internal air pressure is reduced, such as by way of lowered signal level to the transducer, the pressure vent will allow external air to slowly return back inside the enclosure, maintaining equilibrium. The damping material may be chosen to control and optimize the pressure equilibration necessary for a given situation. The damping material may also be optimized to minimize extraneous higher frequency pressure vent "noises", in addition to masking that occurs by primary output from the transducer's diaphragm.

Figure 2:
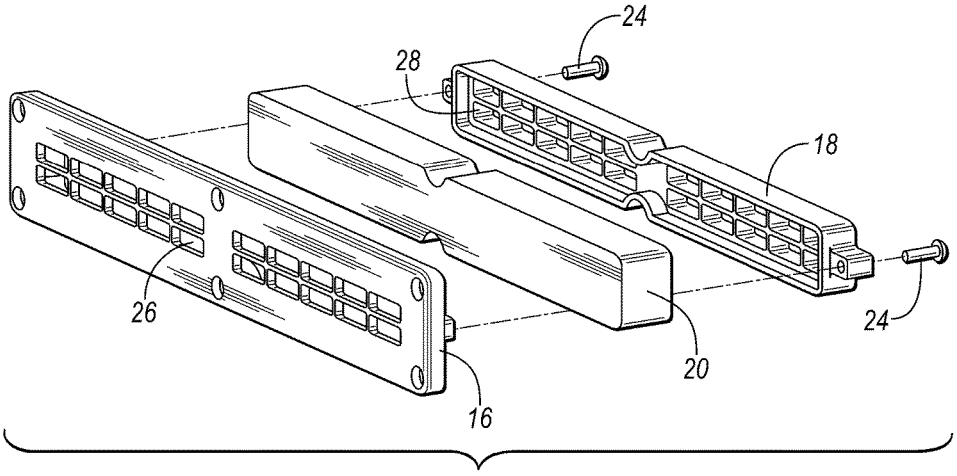
FIG. 2 is an exploded perspective view of a pressure vent according to an embodiment.
Figure 3:
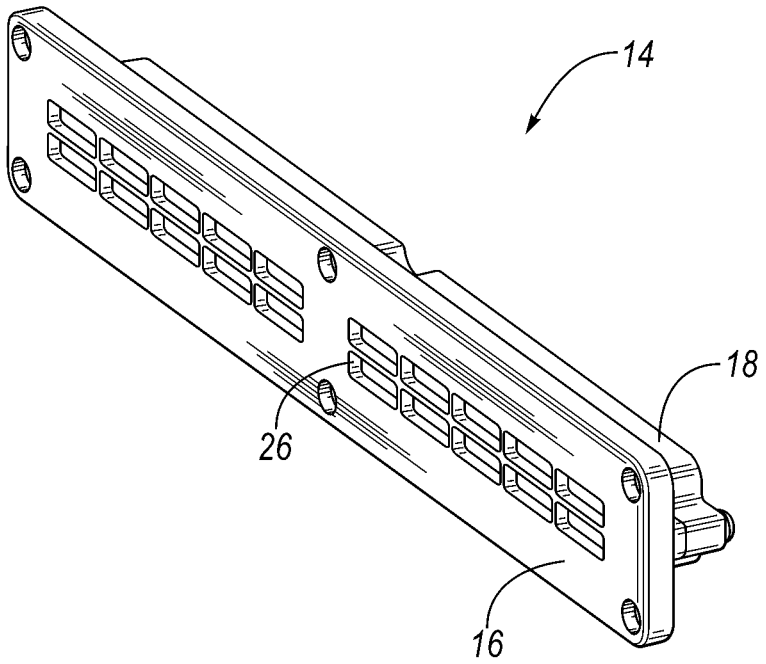
FIG. 3 is a front perspective view of the assembled pressure vent of FIG. 2.
Figure 4:
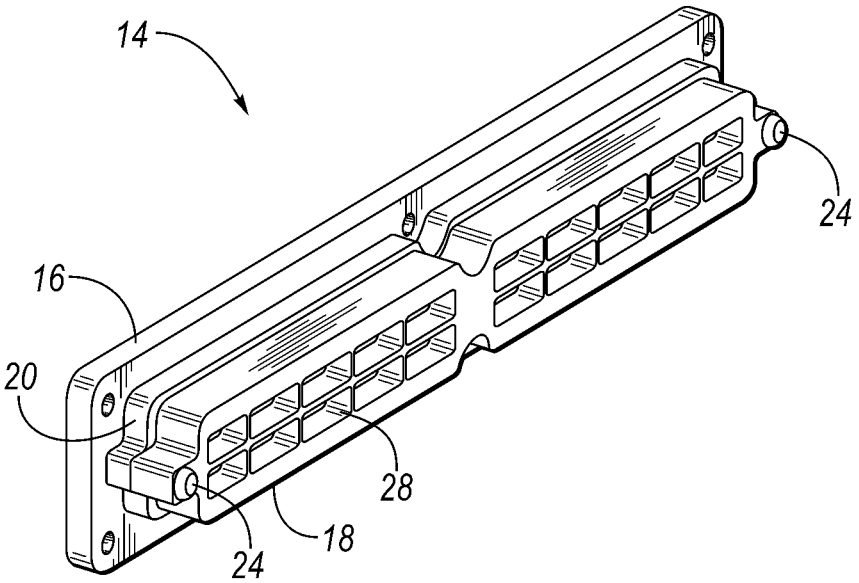
FIG. 4 is a rear perspective view of the assembled pressure vent of FIG. 2.

With reference to FIG. 1, the system 10 includes an enclosure 12 and a speaker or transducer (see FIG. 9) that is positioned within the enclosure 12. A pressure vent 14 is disposed on a rear portion of the enclosure 12, opposite the transducer diaphragm, although this illustrated placement is not intended to be limiting and the pressure vent 14 may disposed at another location on the enclosure 12. With reference to FIGS. 2-4, in this embodiment the pressure vent 14 may include an exterior portion 16, an interior portion 18, and a damping material 20 disposed therebetween. The exterior portion 16, damping material 20, and interior portion 18 may be assembled and mounted in alignment with a corresponding opening 22 in the enclosure 12, such as via screws 24 or other fasteners or with an adhesive.

With further reference to FIGS. 1-4, in this embodiment the exterior and interior portions 16, 18 are generally rectangular and include a plurality of apertures 26, 28 formed therein for properly securing the damping material 20 and allowing air to pass through. It is understood that the pressure vent 14 is not limited to the construction illustrated, and that other sizes, shapes, and configurations of the pressure vent 14 are contemplated. The exterior and interior portions 16, 18 may be constructed from a metallic or plastic material, and the damping material 20 may comprise, for example, but not limited to, a foam, cloth or fiberglass material. In one non-limiting example, the damping material 20 may have a thickness of between about 0.25 and 1.50 inches, such as, for example, 0.75 inches, although other dimensions are contemplated. The thickness of the damping material 20 may be achieved by combining a plurality of dimensionally thinner layers. The damping material 20 may have any thickness, density or other material properties suitable to control the rate of achieving pressure equilibrium or to obtain a required acoustic resonance.

Figure 5:
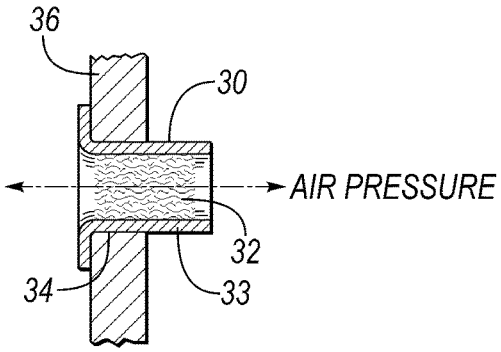
FIG. 5 illustrates a cross-sectional view of a pressure vent according to another embodiment.

With reference to FIGS. 5-9, additional embodiments of pressure vents are illustrated, wherein the description above regarding pressure vent 14 and its damping material 20 may also be applicable to these further embodiments. In FIG. 5, an internal pressure vent 30 may include a damping material 32 and comprises a channel member 33 extending through an opening 34 in a speaker enclosure 36, allowing air to move between an interior and an exterior of the enclosure 36. The channel member 33 may be mounted to the enclosure 36 by fasteners or adhesive. The length, width and geometric configuration of the channel member 33 may vary depending upon the specifications of the associated speaker and enclosure 36.

Figure 6:
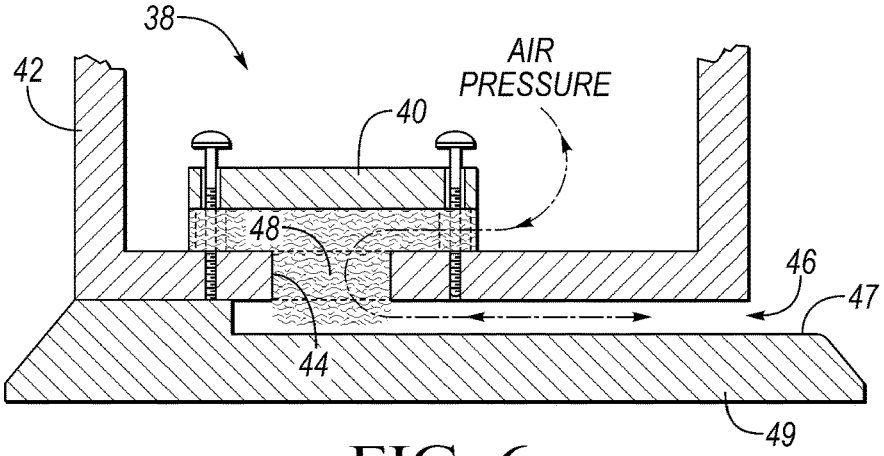
FIG. 6 illustrates a cross-sectional view of a pressure vent according to another embodiment.

In FIG. 6, a pressure vent 38 is illustrated which includes a baffle 40 mounted internally to the enclosure 42 aligned with an opening 44. A pressure transfer channel 46 is formed in the enclosure 42 in fluid communication with the opening 44 to allow air to be transferred from the interior to the exterior of the enclosure 42 and vice versa, where an external outlet 47 of the pressure transfer channel 46 is spaced remotely from the opening 44. Damping material 48, which may be compressed, may be disposed between the baffle 40 and the opening 44. The pressure transfer channel 46 may be formed in a base 49 of the enclosure 42 as shown, or in any other part of the enclosure 36.

Figure 7:
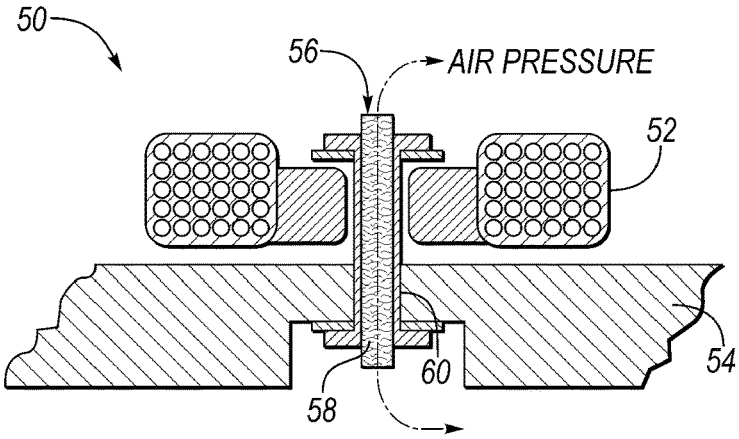
FIG. 7 illustrates a cross-sectional view of a pressure vent according to another embodiment.

In FIG. 7, a pressure vent 50 is illustrated which is formed by modifying existing mounting hardware such as, but not limited to, hardware for mounting a toroidal transformer 52. In such an embodiment, a bolt which would typically mount the transformer 52 to the enclosure 54 may be replaced by a hollow fastener, such as a threaded pipe 56, which may be formed with or packed with a damping material 58. The pipe 56 extends through an opening 60 in the enclosure 54, allowing for a balance of air pressure between the interior and the exterior of the enclosure 54. The opening 60 and pipe 56 may be disposed on any surface of the enclosure 54.

Figure 8:
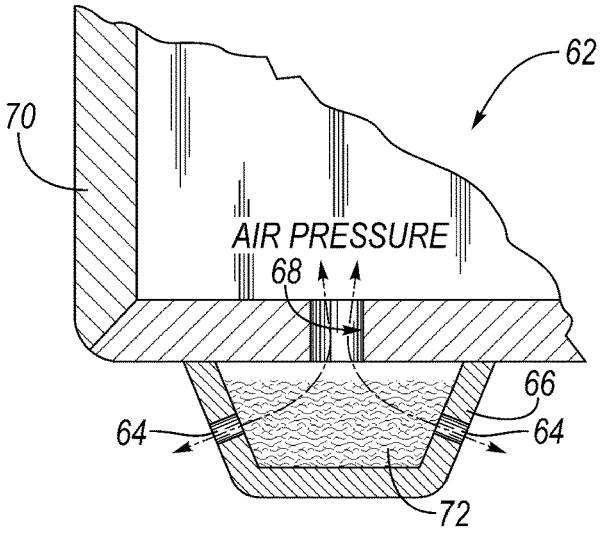
FIG. 8 illustrates a cross-sectional view of a pressure vent according to another embodiment.

In FIG. 8, a pressure vent 62 is illustrated which includes at least one channel 64 formed in an enclosure support member 66, such as a foot. The enclosure support member 66 is aligned with an opening 68 formed in the enclosure 70, such as on a base of the enclosure 70, and the opening 68 is in fluid communication with the channel(s) 64 to form at least one pressure transfer path, allowing air pressure to be transferred between the interior and the exterior of the enclosure 70. A damping material 72, which may be compressed, may be disposed within the enclosure support member 66.

Figure 9:
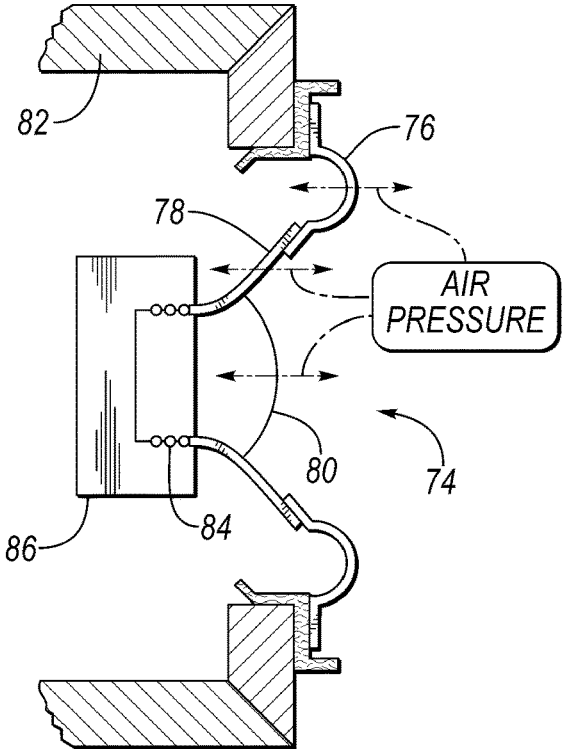
FIG. 9 illustrates a cross-sectional view of a pressure vent according to another embodiment.

In FIG. 9, a pressure vent 74 is illustrated which is formed in this embodiment by construction of one or more of the outer suspension (surround) 76, transducer diaphragm (cone) 78, and dust dome 80 mounted in the enclosure 82 using a damping material. This is shown in FIG. 9 as a partial transducer assembly cross-section, which also depicts a voice coil 84 and motor assembly 86. It is possible that, in some applications, only a suspension 76 and a diaphragm 78 will be utilized, where the dust dome 80 may be combined to be one piece with the diaphragm 78. A pressure transfer route or routes is created through any one or all of the outer suspension 76, the transducer diaphragm 78, and the dust dome 80 components by optimizing their material porosity to allow air to be transferred at a specific desired rate. In this embodiment, the transfer of air pressure between the interior and the exterior of the enclosure 82 is allowed by one or more of the actual suspension 76, transducer diaphragm 78 and dust dome 80 without the need for a separate pressure vent part.

Figure 10:
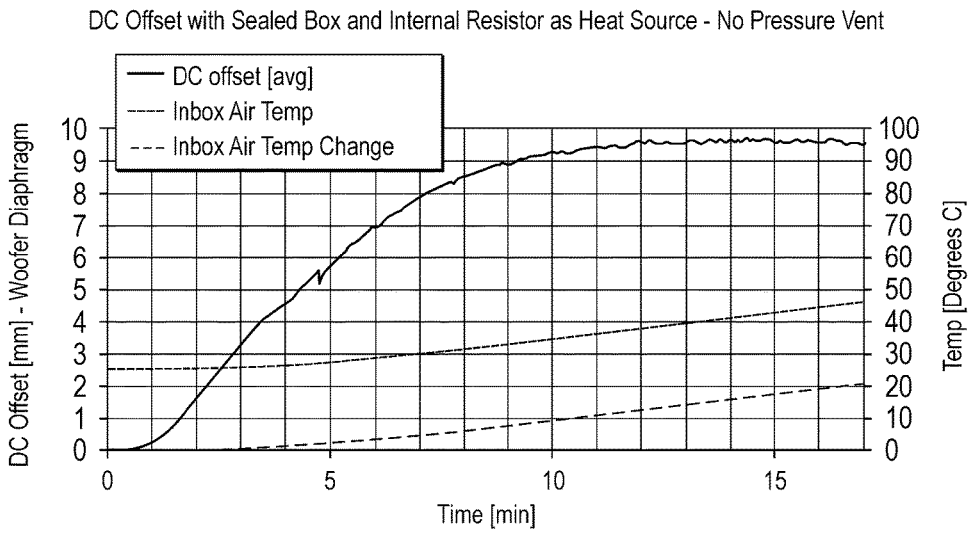
FIG. 10 (Prior Art)
FIG. 10 is a graph of DC offset for a prior art configuration of a transducer diaphragm in a sealed enclosure using an internal resistor as a heat source without a pressure vent.

In FIG. 10, a graph of DC offset for a prior art configuration of a transducer is illustrated by actual displacement measurements for a transducer diaphragm in a sealed box using an internal resistor as a heat source and without a pressure vent. In this experiment, a signal was applied to the resistor heat source placed within the enclosure to increase the internal enclosure temperature. No connection was applied to the transducer in order to observe DC offset without including non-linear effects of an operating transducer. Temperatures were monitored and plotted by thermal tracking software and the diaphragm DC offset was monitored and plotted by a displacement laser and software. The significant DC offset of the diaphragm can be observed on the graph as the temperature increases.

Figure 11:
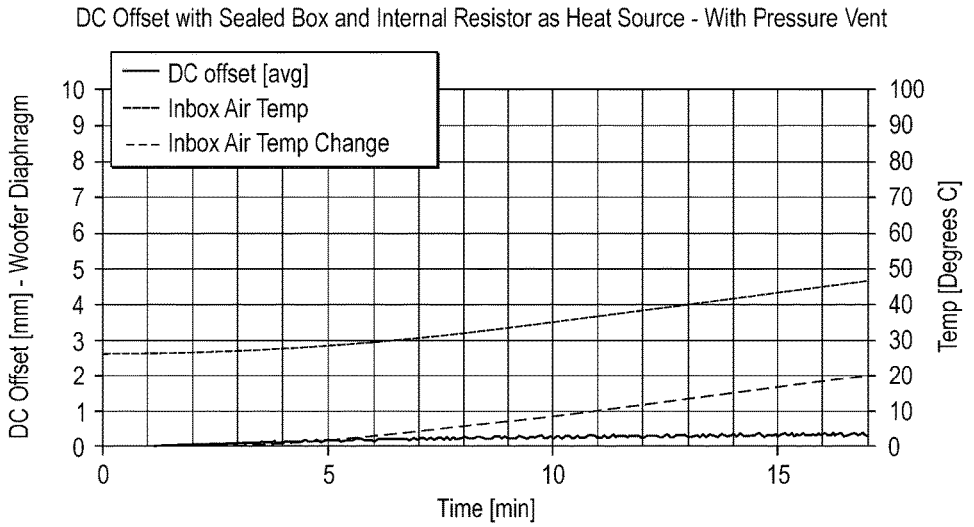
FIG. 11 is a graph of DC offset for a transducer diaphragm in a sealed enclosure using an internal resistor as a heat source with a pressure vent.

In FIG. 11, a graph of DC offset of a transducer is illustrated by actual displacement measurements for a transducer diaphragm in a sealed box using an internal resistor as a heat source and with the application of a pressure vent. In this experiment, a signal was applied to the resistor heat source placed within the enclosure to increase the internal enclosure temperature exactly the same as the experiment described in reference to FIG. 10. No connection was applied to the transducer in order to observe DC offset without including non-linear effects of an operating transducer. Temperatures were monitored and plotted by thermal tracking software and the diaphragm DC offset was monitored and plotted by a displacement laser and software. As illustrated, the DC offset of the diaphragm is essentially zero and independent of the temperature increase, such that in this experiment the use of the pressure vent eliminates DC offset.

Figure 12:
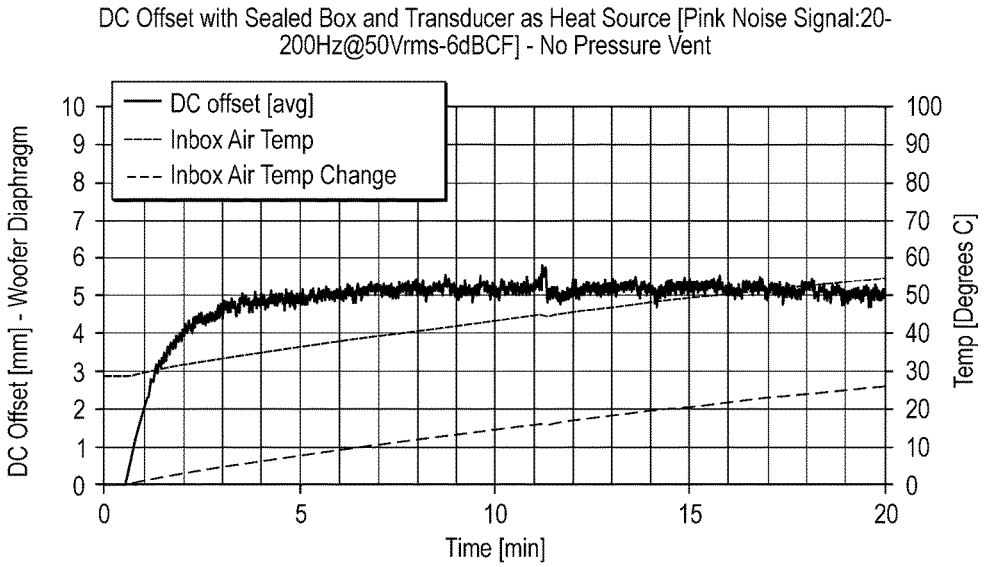
FIG. 12 (Prior Art)
FIG. 12 is a graph of DC offset for a prior art configuration of a transducer diaphragm in a sealed enclosure using a transducer as a heat source and a pink noise signal without a pressure vent.

In FIG. 12, a graph of DC offset for a prior art configuration of a transducer is illustrated by actual displacement measurements for a transducer diaphragm in a sealed box using an actual transducer under operation as a heat source and without a pressure vent. In this experiment, a filtered pink noise signal was applied to the actual transducer to generate heat within the enclosure to increase the internal enclosure temperature. Temperatures were monitored and plotted by thermal tracking software and the diaphragm DC offset was monitored and plotted by a displacement laser and software. As shown, the DC offset of the diaphragm is significant as the temperature increases.

Figure 13:
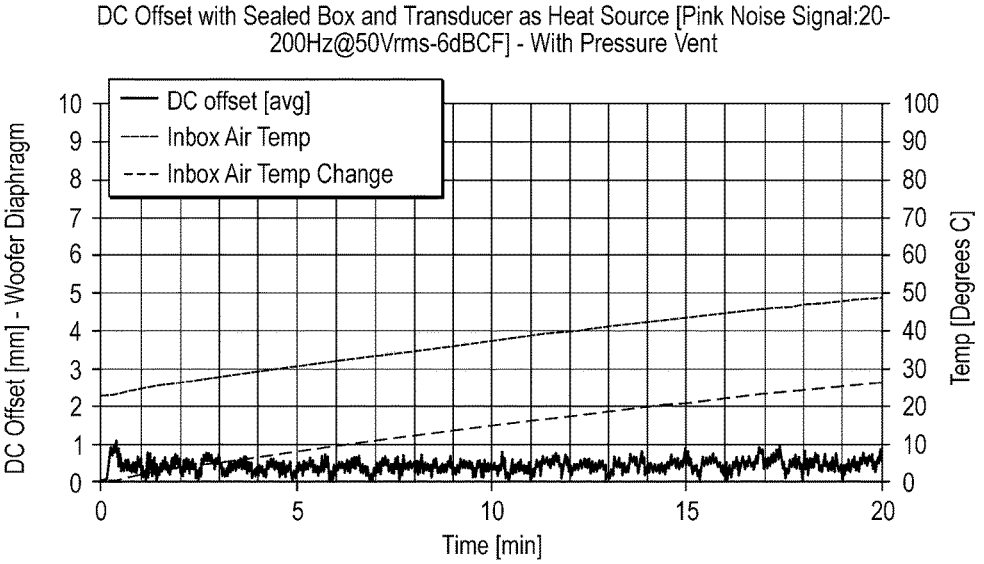
FIG. 13 is a graph of DC offset for a transducer diaphragm in a sealed enclosure using a transducer as a heat source and a pink noise signal with a pressure vent.

In FIG. 13, a graph of DC offset of a transducer is illustrated by actual measurements for a transducer diaphragm in a sealed box using an actual transducer under operation as a heat source and with the application of a pressure vent. In this experiment, a filtered pink noise signal was applied to the actual transducer to generate heat within the enclosure to increase the internal enclosure temperature exactly the same as in the experiment referenced with respect to FIG. 12. Temperatures were monitored and plotted by thermal tracking software and the diaphragm DC offset was monitored and plotted by a displacement laser and software. As illustrated in the graph, the DC offset of the diaphragm is essentially zero and independent of the temperature increase. Therefore, in this experiment, use of the pressure vent eliminates the DC offset.

Figure 14:
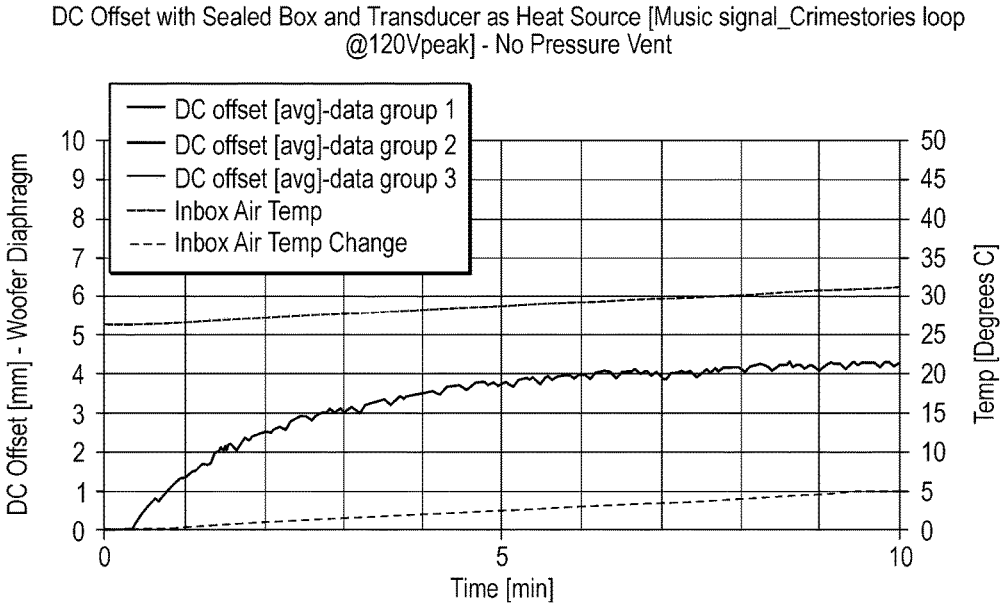
FIG. 14 (Prior Art)
FIG. 14 is a graph of DC offset for a prior art configuration of a transducer diaphragm in a sealed enclosure using a transducer as a heat source and a music signal without a pressure vent.

In FIG. 14, a graph of DC offset for a prior art configuration of a transducer is illustrated by actual displacement measurements for a transducer diaphragm in a sealed box using an actual transducer under operation as a heat source and without a pressure vent. In this experiment, a music signal was applied to the actual transducer to generate heat within the enclosure to increase the internal enclosure temperature. Temperatures were monitored and plotted by thermal tracking software and the diaphragm DC offset was monitored and plotted by a displacement laser and software. Once again, as depicted in the graph, the DC offset of the diaphragm is significant as the temperature increases.

Figure 15:
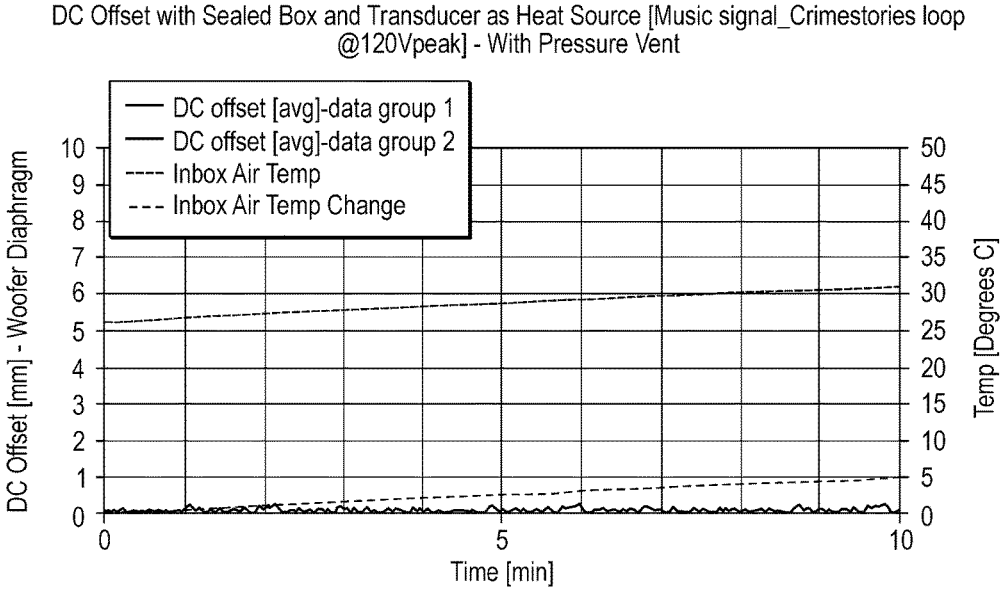
FIG. 15 is a graph of DC offset for a transducer diaphragm in a sealed enclosure using a transducer as a heat source and a music signal with a pressure vent.

Lastly, in FIG. 15, a graph of DC offset of a transducer is illustrated by actual measurements for a transducer diaphragm in a sealed box using an actual transducer under operation as a heat source and with the use of a pressure vent. In this experiment, a music signal was applied to the actual transducer to generate heat within the enclosure to increase the internal enclosure temperature exactly the same as in the experiment referenced with respect to FIG. 14.

Temperatures were monitored and plotted by thermal tracking software and the diaphragm DC offset was monitored and plotted by a displacement laser and software. As shown, the DC offset of the diaphragm is essentially zero and independent of the temperature increase thus, in this experiment, use of the pressure vent eliminates the DC offset.

In addition to the sealed enclosure woofer and subwoofer systems described herein, use of the pressure vent with a full range loudspeaker (e.g., for frequencies between 20 Hz and 20 KHz) or a mid-range driver (e.g. for frequencies between approximately 250 Hz and 2 KHz) is also contemplated. Furthermore, while the pressure vent is described herein for use in a sealed enclosure woofer or subwoofer system with only active transducers, it can also be used in "ported" enclosure woofer or subwoofer systems where the port is actually a passive radiator (or non-active transducer). By nature of its design, the passive radiator diaphragm and suspension will not allow internal air pressure to escape. In this case, it can be described as a "sealed" system, but by name only as it will still acoustically function as a higher order passive radiator system. Depending on suspension stiffness of both the passive radiator and the active transducer, now one or both diaphragms can encounter DC offset due to internal increase in air pressure. The pressure vent can be used to alleviate this condition and restore stability and linear motion to both the passive radiator and the active transducer.

In one embodiment, a pressure vent could be used without damping material. In such an embodiment, the pressure vent would comprise a hole in the enclosure. With a small enough hole and with hole size optimized, under dynamic motion condition of the transducer diaphragm the enclosure may still exhibit "sealed box" characteristics while allowing pressure to be transferred between the interior and the exterior of the enclosure.

The pressure vents described herein may be optimized for appropriate operation depending on the size of the transducer, the size of the enclosure, and the level of temperature increase inside the sealed enclosure based on the power applied to the transducer, as all of these factors contribute to the internal pressure increase and level of DC offset to which the transducer diaphragm/coil assembly will be subjected. The operation of the pressure vent may be further optimized by selection of the placement of the vent, the area/volume of the vent, and the density and porosity of damping material of the vent. This optimizing is not only for the best performance of pressure transfer, but also to reduce audibility of extraneous higher frequency noises emitted from the pressure vent as air is forced through the damping material by way of transducer diaphragm motion.

Pressure venting improves system performance by maintaining constant internal enclosure pressure and making it pressure-independent with regard to temperature rise. This allows the transducer to maintain stable and symmetrical diaphragm behavior as if mounted in free-air by eliminating DC offset or rectification as well as minimizing or eliminating any non-linear compression of air. Improvements of 10-15 dB less distortion (primarily $2^{nd}$ harmonic) have been realized in testing and the more symmetrical behavior of coil movement has shown 10-30 degrees lower coil temperature, depending on motor topology.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A sealed speaker system, comprising: an enclosure including an opening provided in a base thereof;

a transducer diaphragm mounted within the enclosure, wherein an increase in air pressure within the enclosure results in an outward movement of the diaphragm toward an exterior of the enclosure, and a decrease in air pressure within the enclosure results in an inward movement of the diaphragm toward an interior of the enclosure; and a pressure vent provided in a base of the enclosure including an enclosure support member mounted exteriorly to the base and supporting the enclosure on a surface, the enclosure support member abutted against the base adjacent the enclosure opening, the enclosure support member having at least one channel formed therein in fluid communication with the opening, the pressure vent allowing a gradual transfer of air between the enclosure interior and the enclosure exterior to substantially maintain a pressure equilibrium between the enclosure interior and the enclosure exterior.

2. The system of claim 1, wherein the transducer diaphragm is mounted within a front wall of the enclosure.

3. The system of claim 1, wherein the enclosure support member includes a damping material provided therein.

4. The system of claim 3, wherein the damping material includes at least one of a foam, cloth or fiberglass material.

5. The system of claim 1, further comprising a voice coil attached to the diaphragm for driving motion of the diaphragm in response to an electrical signal.

6. A sealed speaker system, comprising: an enclosure including an opening in a base thereof;

a transducer diaphragm mounted within the enclosure, wherein an increase in air pressure within the enclosure results in an outward movement of the diaphragm toward an exterior of the enclosure, and a decrease in air pressure within the enclosure results in an inward movement of the diaphragm toward an interior of the enclosure; and a pressure vent provided in the base of the enclosure including a foot mounted exteriorly to the base and supporting the enclosure on a surface, the foot abutted against the base adjacent the enclosure opening, the foot having a plurality of channels formed therein in fluid communication with the opening, the pressure vent allowing a gradual transfer of air between the enclosure interior and the enclosure exterior to substantially maintain a pressure equilibrium between the enclosure interior and the enclosure exterior.

7. The system of claim 6, wherein the foot includes a damping material provided therein.

8. The system of claim 7, wherein the damping material includes at least one of a foam, cloth or fiberglass material.

9. The system of claim 6, further comprising a voice coil attached to the diaphragm for driving motion of the diaphragm in response to an electrical signal.

10. A sealed woofer system, comprising:

an enclosure including an opening in a base thereof;

a transducer diaphragm mounted within the enclosure by a flexible suspension and having a rest position, wherein an increase in air pressure within the enclosure results in an outward movement of the diaphragm from the rest position toward an exterior of the enclosure, and a decrease in air pressure within the enclosure results in an inward movement of the diaphragm from the rest position toward an interior of the enclosure;

a voice coil attached to the diaphragm for driving motion of the diaphragm in response to an electrical signal; and a pressure vent provided in the base of the enclosure including an enclosure support member mounted exteriorly to the base and supporting the enclosure on a surface, the enclosure support member aligned with the enclosure opening, the enclosure support member having at least one channel formed therein in fluid communication with the opening, the enclosure support member including a damping material provided therein, the pressure vent allowing a gradual transfer of air between the enclosure interior and the enclosure exterior to substantially maintain a pressure equilibrium between the enclosure interior and the enclosure exterior and to substantially return the diaphragm to the rest position in the absence of an electrical signal to the voice coil.

11. The system of claim 10, wherein inward and outward movement of the diaphragm is symmetric about the rest position.

12. The system of claim 10, wherein the damping material includes at least one of a foam, cloth or fiberglass material.

* * * * *